US005120099A

United States Patent [19]

Fletcher

[11] Patent Number: 5,120,099

[45] Date of Patent: Jun. 9, 1992

[54] SUBMERSIBLE GRAPPLING DEVICE

[76] Inventor: Gerald L. Fletcher, Box 6, KBYCL Jakarta, Indonesia, 12340

[21] Appl. No.: 660,729

[22] Filed: Feb. 25, 1991

[51] Int. Cl.[5] ..... B25B 9/00; B63C 7/00

[52] U.S. Cl. ..... 294/66.1; 294/100; 114/50; 114/312

[58] Field of Search ..... 294/66.1, 66.2, 100, 294/19.2, 115; 114/50, 52, 54, 330, 338, 312; 441/2

[56] References Cited

U.S. PATENT DOCUMENTS

| | | | |
|---|---|---|---|
| 692,001 | 1/1902 | Barker | 114/50 |
| 1,350,123 | 8/1920 | Theodore | 294/100 X |
| 2,355,086 | 8/1944 | Lang | 294/66 |
| 3,276,807 | 10/1966 | Ward | 294/66 |
| 3,434,443 | 3/1969 | Estabrook | 114/50 X |
| 3,647,253 | 3/1972 | Hettinger et al. | 294/66 |
| 3,756,644 | 9/1973 | Rydberg | 294/66 R |
| 3,777,708 | 12/1973 | Vogt | 294/19.1 X |
| 3,800,346 | 4/1974 | White | 114/50 X |
| 3,850,286 | 11/1974 | Tobin, Jr. | 294/100 X |
| 3,926,464 | 12/1975 | Alexander | 294/19 A |
| 3,929,367 | 12/1975 | Bjurling et al. | 294/100 X |
| 4,021,068 | 5/1977 | Piazza | 294/19 A |
| 4,214,842 | 7/1980 | Franks | 294/66.2 X |
| 4,410,210 | 10/1983 | De Sivry et al. | 294/99 R |
| 4,463,981 | 8/1984 | Curry | 294/100 |
| 4,549,758 | 10/1985 | Meshulam | 294/19.2 |
| 4,636,241 | 1/1987 | Nebelung | 294/115 X |
| 4,658,745 | 4/1987 | Buecher | 114/50 X |
| 4,979,451 | 12/1990 | Searle | 114/50 X |
| 4,987,634 | 1/1991 | Weihrauch | 294/100 X |

FOREIGN PATENT DOCUMENTS

| | | | |
|---|---|---|---|
| 100993 | 4/1990 | Japan | 294/66.1 |
| 81171 | 12/1952 | Norway | 294/66.1 |

*Primary Examiner*—Robert R. Song
*Assistant Examiner*—Joseph D. Pape
*Attorney, Agent, or Firm*—John E. Reilly

[57] ABSTRACT

A submersible grappling system is designed for retrieving objects, such as, golf balls from the bottom or floor of a body of water and is made up of a tubular housing, a bladder at one end of the housing, finger-like retrieval elements at the opposite end of the housing and a gear column which serves to interconnect the bladder and retrieval elements so that when the gear column is driven in one direction, it will cause the bladder to be compressed within the upper end of the housing while forcing the retrieval elements downwardly and outwardly into surrounding relation to an object to be retrieved, and when the gear column is driven in the opposite direction will cause the bladder to be expanded upwardly away from the housing to increase the effective buoyancy while causing the retrieval elements to be retracted around the object and drawn upwardly into the housing.

15 Claims, 2 Drawing Sheets

SUBMERSIBLE GRAPPLING DEVICE

This invention relates to devices for retrieval of underwater objects; and more particularly relates to a novel and improved submersible device with means for capturing a golf ball or other underwater object to be retrieved, the device also having flotation means for facilitating recovery of the object.

BACKGROUND AND FIELD OF INVENTION

Numerous devices exist for the retrieval of objects that have become submerged underwater; however, most of the devices used for retrieving golf balls are affixed to rods or poles, which by necessity of limitations on length can only retrieve golf balls located at minimal distances from the operator of the device. Examples of such devices are U.S. Pat. No. 4,021,068 to Piazza and U.S. Pat. No. 4,549,758 to Meshulam. Several of the existing underwater retrieval devices must be dragged along the bottom of the body of water after the object has been captured, and therefore cannot function reliably under different conditions. Such devices are exemplified by U.S. Pat. No. 3,756,644 to Rydberg and U.S. Pat. No. 3,276,807 to Ward.

U.S. Pat. No. 3,926,464 to Alexander discloses a golf ball retrieval device which floats, but which can only capture the golf balls at a fixed depth, due to the fixed arrangement of the capture nets with respect to the floating portion of the device.

Two other marine salvage devices of general interest are U.S. Pat. No. 2,355,086 to Lang and U.S. Pat. No. 3,647,253 to Hettinger et al. The '086 patent to Lang employs a casing with a threaded shaft located inside the casing, the shaft being attached to a pair of jaws used to capture the object to be retrieved. This device, however, does not float and must be lowered into the water directly above the object to be retrieved.

The invention disclosed by the '253 patent to Hettinger et al is not submersible and is capable of retrieving only those objects which are floating on the surface of the water. In addition, the "expandable bladder" in the '253 patent functions only as a gripping means, and provides no flotation function.

U.S. Pat. No. 4,410,210 to de Sivry et al employs an inflatable bladder to grip the object to be picked up, but not for flotation purposes. Furthermore, there is no indication that such a device would be used for underwater retrieval.

SUMMARY OF THE INVENTION

It is therefore an object of the present invention to provide for a novel and improved grappling device for retrieval of golf balls and other submerged objects.

It is another object of the present invention to provide for a novel and improved means for retrieval of an object submerged underwater where said object is located at a distance from the operator greater than that practical for retrieval with a fixed length of telescoping pole.

An additional object of the present invention is to provide a means for retrieval of objects submerged underwater where said objects are located at varying depths.

A further object of the present invention is to provide a novel and improved means for retrieval of submerged objects located on the floor of a body of water where the terrain of said floor is too rough, uneven or otherwise unsuitable for retrieval of the object by dragging or dredging.

A still further object of the present invention is to provide a device for retrieval of a submerged object, where said device does not have to be lowered into the water by the operator from a point directly above said object.

In accordance with the present invention, there has been devised a grappling device for retrieval of objects submerged underwater, the device comprising a tubular housing containing a gear column with an expandable bladder connected to the top of said column, and grasping means connected to the bottom end of said column.

The grasping means comprises a bucket consisting of a plurality of expandable fingers or jaws which are biased to spring outwardly when the gear column moves in a downward direction, while at the same time the bladder is drawn inwardly into the housing and compressed to reduce its buoyancy and cause the entire device to submerge toward the object to be retrieved. When the fingers are positioned within sufficient proximity to grasp the object, the gear column is raised, causing the fingers to engage and capture the object. The gear column is then further raised, thereby extending a sufficient portion of the bladder above the housing, and the bladder expanding to an extent necessary to cause the entire device to become buoyant and rise to the surface of the water, thus facilitating retrieval of the object.

The system as devised lends itself well to remote control operation, such as, by a handheld control console and which will manuever the system into position. The manuevering and operating elements can also be activated through electrical conduits contained in an umbilical cord running to the system from the control console.

The above and other objects, advantages and features of the present invention will become more readily understood and appreciated from a consideration of the following detailed description of a preferred embodiment when taken together with the accompanying drawings in which:

DETAILED DESCRIPTION OF THE PREFERRED EMBODIMENT

Figure 1:
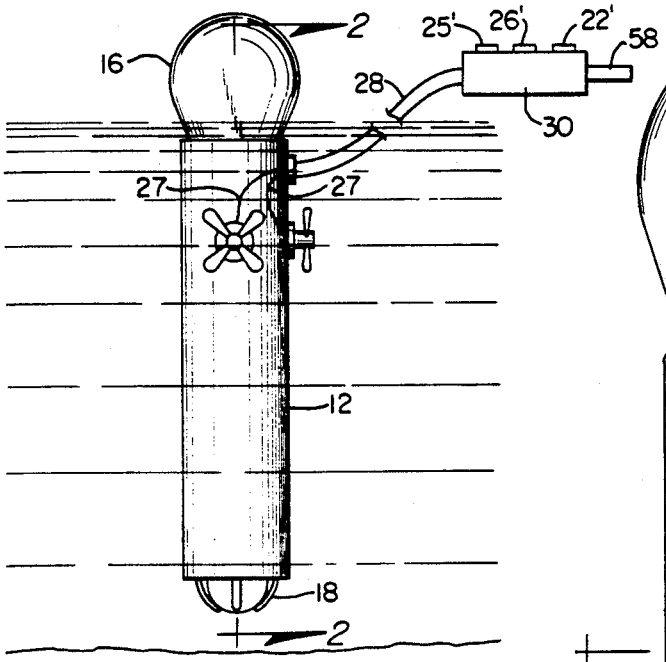
FIG. 1 is an elevational view of a preferred form of grappling device submerged in a body of water and illustrating the relationship between parts after retrieval of an object from the bottom or floor of the body of water.
Figure 3:
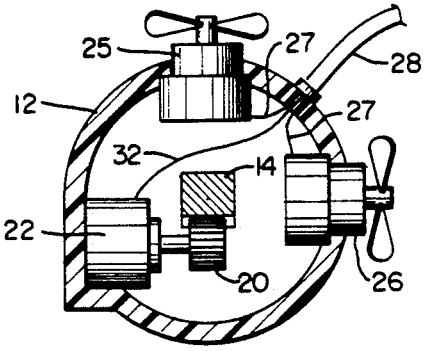
FIG. 3 is a cross-sectional view taken about lines 3—3 of FIG. 2.

Referring in more detail to the drawings, there is illustrated in FIGS. 1 to 6 a preferred form of grappling device 10 which is broadly comprised of an outer generally tubular housing 12, a gear column 14 extending along the longitudinal axis of the housing, an inflatable bladder 16 at the upper end of the gear column 14, and grasping means in the form of spring-like expandable fingers or jaws 18 suspended from the lower end of the gear column. A pinion 20 is connected to an output shaft of a drive motor 22 for intermeshing engagement with a rack 24 on the gear column. Propeller drive means 25 and 26 are affixed at 90° to one another on the housing 12 with electrical wires 27 extending to each of the drive means 25 and 26 and which electrical wires 27 pass through an umbilical cord 28 to a remote control panel 30. Wires 32 also extend from the umbilical cord 28 for selectively energizing the motor drive 22 for the pinion 20.

As will become more apparent hereinafter, various propulsion means could be employed to advance the grappling device 10 of the present invention through the water, and the propeller drives 25 and 26 are merely illustrative of devices that might be employed. In this regard, the control panel suitably includes separate control switches 25' and 26' for the respective propeller drives 25 and 26 to regulate the speed and direction of advancement through the water. Essentially, the propeller drive units 25 and 26 are intended for advancing the entire device in a horizontal direction along the water, and a separate switch 22' serves to activate the gear drive 22 in determining the vertical movement of the grappling device through the water. Typically, the remote control unit 30 would be held by the operator on the shoreline or in a boat to regulate the advancement of the unit 10 through the water.

Figure 2:
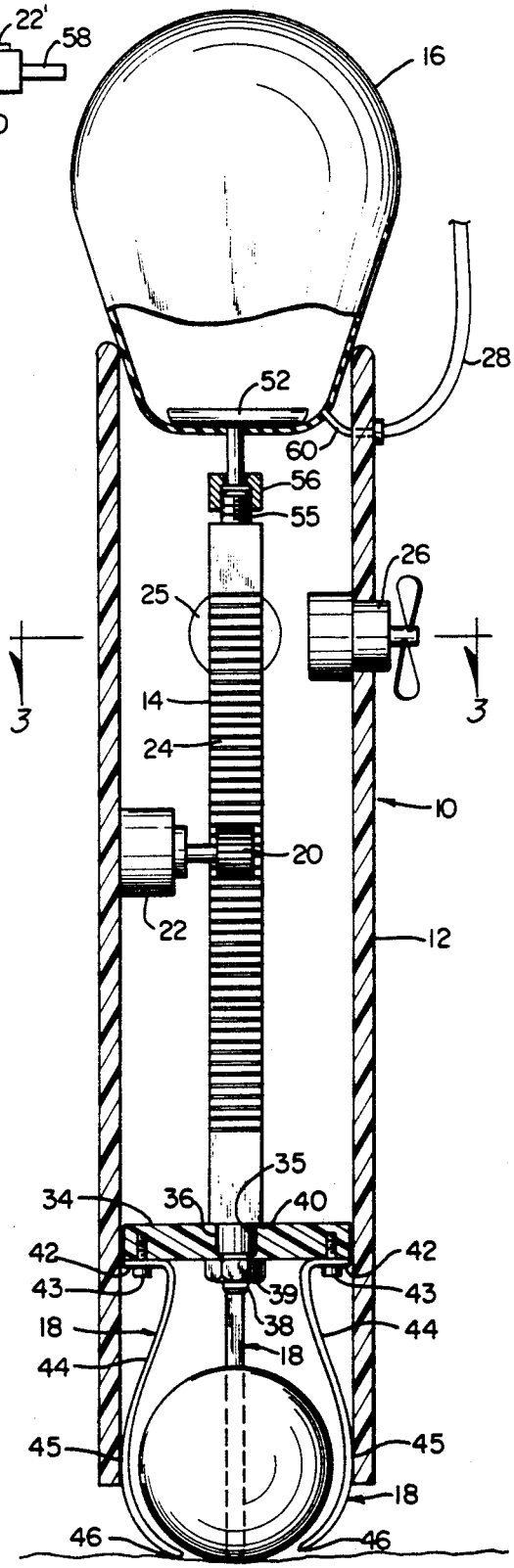
FIG. 2 is an enlarged, longitudinal section view taken about lines 2—2 of FIG. 1.
Figure 4:
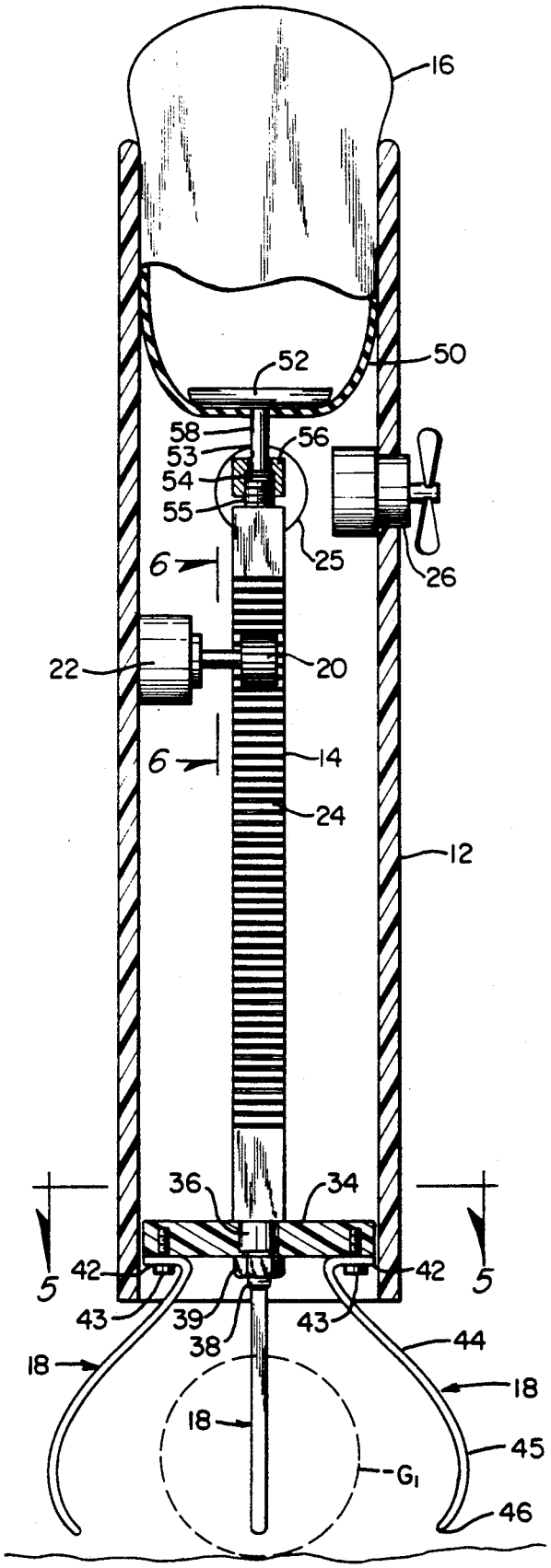
FIG. 4 is another longitudinal section view illustrating the grappling device in position preliminary to retrieval of an object.
Figure 5:
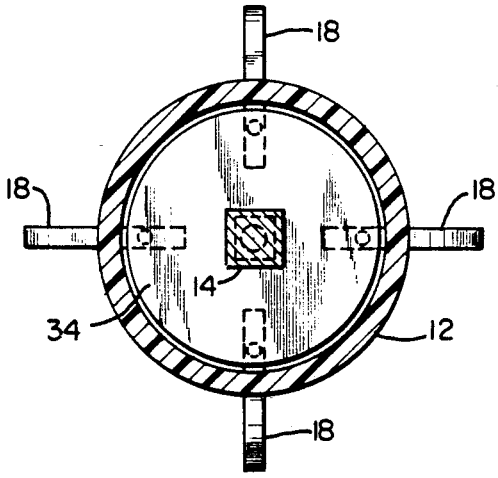
FIG. 5 is a cross-sectional view taken about lines 5—5 of FIG. 4.
Figure 6:
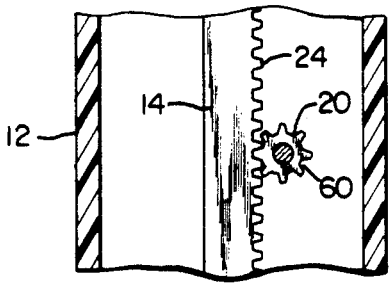
FIG. 6 is a sectional view taken about lines 6—6 of FIG. 5.

Referring in more detail to the construction and arrangement of a preferred form of unit 10, the retrieval basket or fingers 18 includes a rigid base plate 34 in the form of a circular disk provided with a square central opening 35 for insertion of a lower square-sectioned portion 36 of the gear column 14. A lower threaded end 38 projects downwardly beyond the square-sectioned portion 36 and the base plate 34 to receive a nut 39 which retains the plate 34 securely in place against a shoulder 40 on the gear column directly above the square-sectioned portion 36. Preferably, each of the fingers 18 is a spring-like tine element arranged in equally spaced circumferential relation for downward extension from the base plate 34. Each finger 18 includes an upper, flat attaching end 42 which is affixed by a screw 43 extending through a bore in the attaching end 42 into the body of the base plate 34, and a radially outwardly and downwardly extending portion 44 terminating in a generally convex, lower free end 45 having a radially inwardly directed extremity 46. Each finger is preloaded such that in its normally expanded state, as shown in FIG. 4, will diverge in a radial outward direction well beyond the outside of the housing 12; however, when drawn upwardly into the lower end of the housing 12 will be caused to retract into a more nearly vertical disposition, as shown in FIG. 2, so that the lower extremities 46 are in close proximity to one another. Thus, for example, the fingers 18 may be composed of spring steel and may be suitably varied in length and spring tension according to the intended application. In the particular configuration illustrated in the preferred form, the fingers 18 are designed primarily for retrieval of golf balls from lakes or ponds; and, for instance, a series of six fingers may be arranged at equally spaced circumferential relation around the outer periphery of the base plate 34. Other applications, such as, retrieval of soil samples may dictate the use of wider or broader type configurations and which may be more of a petal-shaped configuration with the sides of the fingers in abutting or closely spaced relation to one another. In either case, when the arms are retracted inside of the housing 12, they will be forced at their lower extremities into a closed position, as shown in FIG. 2.

In order to regulate the effective buoyancy of the device 10, the inflatable bladder 16 is affixed to the upper end of the gear column 14. The bladder includes a lower convergent end portion 50 having a metal plate 52 molded into the interior of its lower end, and a downwardly projecting connecting shaft 53 is enlarged as at 54 to abut an upper threaded end portion 55 of the gear column 14. A lock nut 56 encircles the lower end of the connecting shaft and threadedly engages the end portion 55 to tighten the shaft securely to the upper end of the gear column. Although not shown, the connecting shaft may house a suitable valve stem which extends upwardly into communication with the interior of the bladder for the purpose of inflating and deflating the bladder through a central bore 58. The bladder is air or gas-filled to the desired extent to regulate the degree of buoyancy when the bladder is in the raised position protruding above the housing 12, for example, as shown in FIG. 2. When the gear column is driven in a downward direction in a manner to be described, the bladder will be contracted within the housing thereby reducing its effective buoyancy. In other words, the lift imparted to the device will be a function of the amount of water displaced by the bladder and will increase as the bladder is allowed to protrude upwardly from the top of the housing so that it is not necessary to inflate and deflate the bladder each time that a retrieval operation is carried out. In this relation, the size of the bladder will determine the amount of lift or buoyancy of the system, and its degree of inflation can be regulated according to the weight of objects to be lifted. In the case of golf balls, relatively little buoyancy change is required.

Preferably, the gear column 14 is a single shaft of generally rectangular or square cross-section having the rack or gear teeth 24 arranged along one flat surface of the shaft. The pinion 20 includes toothed elements 60 which intermeshingly engage with the rack 24. Preferably, the motor drive 22 is a servo motor affixed to the inner wall of the housing and when activated will cause the gear column 14 to advance in an upward or downward direction with respect to the housing. Thus, downward movement of the gear column 14 will cause the bladder 16 to be retracted within the upper end of the housing while the fingers 18 advance downwardly into an expanded position, as shown in FIG. 4, to move into surrounding relation to an object to be retrieved, such as, a golf ball represented at G in FIG. 4. The motor drive is then reversed to cause the gear column 14 to be driven upwardly thereby causing the fingers 18 to be contracted into a closed position surrounding the golf ball G; and simultaneously the bladder 16 will be free to advance upwardly through the upper end of the housing to progressively increase the buoyancy of the device 10 and cause it to rise to the surface. The device may then be drawn or directed to the shore or to the side of a boat and the object G manually retrieved or extracted from the lower end. The device is then replaced in the water and manuevered away from the boat or shore by activation of the propeller units 25 and 26.

From the foregoing, in retrieving objects from underwater locations, the device is steered to a position over the object to be retrieved by the control switches 25' and 26' and with the bladder in a buoyant or raised position. The control switch 22 is then switched on to activate the motor drive 22 in a direction causing the gear column to be lowered thereby retracting the bladder 50 and advancing the fingers 18 into the lower, expanded position. As a result, the effective buoyancy of the device is reduced so that it will move downwardly until the fingers move into surrounding relation to an object to be retrieved. The motor 22' is then reversed to raise the gear column 14 causing the fingers 18 to move upwardly into the lower end of the housing and the bladder to be advanced upwardly to project above the upper end of the housing thereby increasing the effective buoyancy so that the device will rise to the surface. Again, steering the device 10 to the desired location is accomplished by activating one or the other or both horizontally mounted propeller units 25 and 26. Preferably, these are driven by small battery-operated electric reversible drive motors mounted on the sidewalls of the housing, and the switches 25' and 26' may be a suitable form of three-way switch for forward and reverse operation of the motors for the propeller units 25 and 26. The umbilical cord 28 will cooperate in orienting the device in a substantially upright position as it is advanced through the water by the propeller units 25 and 26. Although a single gear column 14 can be employed for retrieving lighter objects, such as, golf balls separate gear columns can be employed to independently control the advancement and retraction of the grasping elements or fingers 18 and the bladder 50 to retrieve larger articles. In this way, the buoyancy of the device can be regulated independently of the fingers 18. Moreover, while the fingers 18 have been described as being composed of spring steel, they can be made of a molded plastic, and separate spring elements may be utilized to control expansion of the fingers 18 from the lower end of the housing.

Depending upon the degree of buoyancy change required, in many applications it may be desirable to incorporate means for controlling the degree of inflation of the bladder 16. To this end, a $CO_2$ cartridge or other compressed gas source 58 may form a part of the control console 30 and through a control line 60 into the bladder itself can be operated to regulate the degree of inflation and therefore effective buoyancy of the system.

It is therefore to be understood that while a preferred form of invention is herein set forth and described, various modifications and changes may be made without departing from the spirit and scope of the present invention as defined by the appended claims and reasonable equivalents thereof.

I claim:

1. In a grappling device for retrieving objects located underwater, the improvement comprising:

a tubular housing having an upper end and a lower end;

expandable flotation means at one end of said housing for selective flotation of said device, first drive means at said one end for advancing said flotation means between a retracted, reduced buoyant position within said housing and a buoyant position externally of said housing; and grasping means at an opposite end of said housing for grasping an object to be retrieved.

2. In a grappling device according to claim 1, second drive means at said opposite end for advancing said grasping means between an expanded position externally of said housing for encircling said object and a contracted position within said housing.

3. In a grappling device according to claim 2, connecting means inside said housing for interconnecting said first and second drive means.

4. In a grappling device according to claim 3, gear drive means for urging said connecting means upwardly and downwardly within said housing.

5. In a grappling device according to claim 1, said flotation means comprising an expandable bladder capable of being compressed so that said bladder may be at least partially contained within said housing.

6. In a grappling device according to claim 5, said expandable bladder located near said upper end of said housing.

7. In a grappling device according to claim 2, said grasping means comprising a plurality of radially disposed resilient fingers.

8. In a grappling device according to claim 1, remote control drive means for advancing said device through the water.

9. In a grappling device according to claim 8, said remote control drive means including a series of motor driven propellers.

10. In a grappling device according to claim 8, said remote control means including an umbilical cord and electrical conductors extending through said cord to said propellers.

11. A submersible device for retrieving objects located underwater, comprising in combination:

a tubular housing having an upper end and a lower end;

expandable flotation means at one end of said housing for selective flotation of said device, said flotation means comprising an expandable bladder capable of being compressed so that said bladder may be at least partially contained within said housing; and grasping means at an opposite end of said housing for grasping an object to be retrieved; and a gear column interconnecting said flotation means and said grasping means.

12. A device according to claim 11, gear drive means for advancing said flotation means between a retracted, reduced buoyant position within said housing and a buoyant position externally of said housing and for advancing said grasping means between an expanded position externally of said housing for encircling said object and a contracted position within said housing.

13. A device according to claim 11, said expandable bladder located near said upper end of said housing.

14. A device according to claim 11, said grasping means comprising a plurality of radially disposed resilient fingers.

15. A device according to claim 11, remote control drive means for advancing said device through the water, said remote control drive means including a series of motor driven propellers.

* * * * *